United States Patent [19]

Bellino et al.

[11] 3,941,230

[45] Mar. 2, 1976

[54] BACKLASH COMPENSATED LINEAR DRIVE METHOD FOR LEAD SCREW-DRIVEN PRINTER CARRIAGE

[75] Inventors: Joseph A. Bellino, Arlington Heights; Leo von Braun, Chicago, both of Ill.

[73] Assignee: Teletype Corporation, Skokie, Ill.

[22] Filed: Aug. 9, 1974

[21] Appl. No.: 495,943

[52] U.S. Cl. ..... 197/90; 74/441; 101/93.15; 197/1 R

[51] Int. Cl.[2] ..... B41J 19/20

[58] Field of Search ..... 197/90, 1 R, 48, 82, 49; 101/93.15, 93.16, 93.17; 74/89.14, 89.15, 424.8 R, 441

[56] References Cited

UNITED STATES PATENTS

| | | | |
|---|---|---|---|
| 3,292,530 | 12/1966 | Martin | 197/1 R |
| 3,313,387 | 4/1967 | Lenney | 197/64 |
| 3,670,861 | 6/1972 | Zenner et al. | 197/64 |
| 3,703,949 | 11/1972 | Howard et al. | 197/1 R |
| 3,715,021 | 2/1973 | Caspari | 197/90 X |
| 3,795,299 | 3/1974 | Nakamura et al. | 197/49 |

*Primary Examiner*—Anton O. Oechsle
*Attorney, Agent, or Firm*—K. R. Bergum; J. D. Kaufmann; J. L. Landis

[57] ABSTRACT

A method of effecting time-linear travel of a lead screw-driven, carriage-mounted print head during the print cycle encompassed within a predetermined period of each motor-initiated advancement thereof. This is accomplished by incorporating a predetermined maximum possible amount of built-in backlash between the threaded coupling member and the lead screw, and by utilizing a predetermined time delay before printing commences so as to compensate for the backlash. The latter is employed to minimize friction and wear due selectively to any tolerance variations in the lead screw-drive nut threads, bow in the lead screw, or misalignment thereof relative to the carriage guide rods. As a result, wear of the moving parts that produce the friction is minimized. Printing of the first indicium associated with each motor-initiated advancement of the carriage is delayed until the stepping motor not only has been accelerated up to the desired rotational speed, but until the threaded member-lead screw backlash has been completely taken up, and any kinetic energy imparted carriage bounce forces resulting therefrom have been damped. As such, the carriage (and print head mounted thereon) will always be smoothly driven and at a substantially constant speed during each print cycle, so that successively printed indicia will be uniformly spaced along each print line. Before the printing of the last indicium is to take place, the motor is decelerated and stopped. Because of the inertia of the carriage and the threaded member-lead screw backlash, the carriage and the print head continue to move at the aforementioned constant speed during the printing of the last indicium.

11 Claims, 4 Drawing Figures

BACKLASH COMPENSATED LINEAR DRIVE METHOD FOR LEAD SCREW-DRIVEN PRINTER CARRIAGE

BACKGROUND OF THE INVENTION

1. Field of the Invention

The present invention relates to printer apparatus and, more particularly, to a method of effecting linear travel of a lead screw driven carriage during the print cycle encompassed within a predetermined period of each stepped advancement thereof.

2. Description of the Prior Art

In lead screw driven matrix printers, a print head with a vertical column of either seven or nine selectively actuable print wires is mounted on a carriage and generally stepped across the width dimension of a print medium, such as paper in roll stock form. In the case of printing 5 × 7 dot matrix characters, the print head obviously must be stepped to five successive dot positions in order to form a print character within each character print column, with three dot spaces normally being employed to separate adjacent characters.

During each successive character column advancement of the print head, selected ones of the seven (or nine) wires are actuated or "fired" on-the-fly so as to drive the ends thereof either against an inked ribbon, and the latter against discrete portions of the paper, or directly against a pressure sensitive recording medium, to thereby effect the printing of a dot matrix character corresponding to the particular print wires actuated.

In such a matrix printer, the carriage is normally driven along a pair of guide rods aligned in parallel relationship with the lead screw. The carriage (and print head mounted thereon) is generally coupled to the lead screw by a threaded member, usually in the form of a drive nut, suitably mounted on the carriage. With the lead screw normally driven by a reversible stepping motor, for example, the rotational displacement of the lead screw is translated through the drive nut into linear displacement of the carriage (and print head). The direction in which the carriage is driven, and the speed of travel thereof, of course, is directly dependent on the direction and speed of rotation of the lead screw. For additional details of one preferred matrix printer of the type generally described hereinabove, and which is applicable for use in practicing the principles of the present invention, reference is made to a commonly assigned copending application of J. L. DeBoo-E. C. Feldy-H. S. Grear, Ser. No. 468,046, filed May 8, 1974, herein incorporated by reference.

While a power driven lead screw in printers of the dot matrix type affords a number of advantages over belts or chains for driving carriage-mounted print heads in terms of simplicity, ruggedness, cost and maximum possible driving speed, they nevertheless have presented a number of troublesome problems heretofore. Specifically, because of the necessity of threads, unless stringent tolerances are adhered to in the manufacture of the lead screw and drive nut, there must normally be either some backlash allowed for therebetween, or some form of a resilient, expandable drive nut employed in order to minimize the possibility of excessive frictional forces being established.

Various attempts to manufacture and mount the lead screw drive nut with stringent tolerances heretofore has proven to be impractical in practice for a number of reasons. First, a lead screw must necessarily extend across the entire width dimension of the printer, i.e., in parallel relationship with the platen and, as such, there is a tendency for the lead screw to inherently have or develop a slight bow which is most pronounced along the intermediate region thereof. Secondly, while the lead screw is normally mounted on precision ball bearings (or bushings), tolerance variations in the bearing mountings as manufactured, or as positioned on supporting frame structure of the printer, invariably leads to slight, but normally troublesome misalignment between the lead screw and carriage guide rods. Thirdly, because of the size of the threads and the axial length of the lead screw, a precision machining operation, as distinguished from a conventional and simple cold rolling operation, to form the threads would prove prohibitive from a cost standpoint.

Accordingly, even if a conventional drive nut could be manufactured to threadedly engage the lead screw in a very close fitting manner with negligible backlash, very high frictional forces would normally still develop not only between the lead screw and drive nut, but also between the lead screw and carriage guide rods. Such frictional forces would lead to excessive wear of the mating parts generating them, and could possibly overcome the driving torque of the stepping motor. In the latter case, the carriage would actually bind or lock-up on the guide rods. Such a problem, of course, could very possibly also seriously damage the drive mechanism in many printers.

Equally important, however, is the fact that any non-uniform frictional forces, whether great enough to actually bind the carriage or not, would necessarily at least alter the speed at which the carriage is either continuously driven or stepped along the guide rods. Such unintended variations in carriage speed during printing cannot be tolerated, as there must be a very precisely correlated relationship between the firing of the print wires (or hammers) and the lateral position of the print head at each successive dot position along a given print line.

In an attempt to solve some of the foregoing problems, specially constructed split nuts with garter springs and spring loaded "double" nuts have been tried, but both have been found to produce less than satisfactory results with respect to minimizing high frictional forces, excessive wear and/or distorted print characters due to non-linear carriage travel.

Thus, in order to reduce excessive frictional forces caused by tolerance variations, attempts have been made to intentionally construct the drive nut with a predetermined degree of backlash, or clearance, between the mating threads of a drive nut and lead screw. It becomes readily apparent, however, that whenever a built-in degree of backlash is employed in a lead screw-drive nut assembly, a substantial degree of kinetic energy is necessarily established by the mass of the coupled carriage, which includes the associated print head, during each advancement thereof. Such kinetic energy can, in turn, establish substantially large and detrimental impact forces between the lead screw and drive nut threads if not compensated for or absorbed in some way. These detrimental forces lead to a "bouncing" condition of the carriage (and print head).

One approach taken heretofore to absorb the abovedescribed type of kinetic energy imparted bounce forces has been to utilize a resilient, shock absorbing member between the drive nut and carriage.

Such a member in one preferred form has comprised an O-ring which, in conjunction with mounting plates, has been further employed to resiliently mount the drive nut in a cantilevered manner on the carriage side wall. This allows the loosely coupled drive nut to acquire a slightly skewed condition relative to the axis of the lead screw, as may be required in order to compensate for inherent bow in the lead screw, and for any misalignment thereof relative to the carriage guide rods. To that end, one prior drive nut design has included both a threaded and an unthreaded bore section, the latter being oversized so as to facilitate radial displacement of the drive nut relative to the lead screw center line. For further details of several preferred embodiments of the above-described type of resiliently mounted drive nut and carriage assembly, reference is made to a commonly assigned copending application of A. F. Lindberg, Ser. No. 468,047, filed May 8, 1974, herein incorporated by reference.

Unquestionably, the above-described type of drive nut and carriage assembly has been found to provide substantial improvement over related prior assemblies in reducing wear, by simultaneously minimizing frictional forces and absorbing a substantial amount of the initial kinetic energy imparted carriage bounce force caused by backlash. However, the shock absorbing coupling member employed therein has been found in certain printers and applications to not always be capable of completely damping the initial impact bounce force. As a result, troublesome transient bounce forces may be generated in certain printers and continue for varying periods of time during the print cycle. This has been found to be particularly true whenever the purposely established backlash between the drive nut and lead screw is in the range of 0.02 to 0.04 inches, and the mass of the carriage and print head is greater than 10 ounces.

The presence of even minimal transient bounce forces, of course, can prove very detrimental, particularly in high speed dot matrix printers, wherein the carriage mounted print head is not only rapidly accelerated and decelerated in connection with each stepped advancement thereof, but has appreciable mass. As previously mentioned, any non-linear variation in the speed of carriage travel during the actual printing of the dots for each matrix character, for whatever reason, cannot be tolerated, as there must be a very precisely correlated relationship between the impact of the print wires upon the record medium and the lateral position of the print head at all times, if uniform dot spacings area to be realized.

SUMMARY OF THE INVENTION

It, therefore, is an object of the present invention to provide a new and improved method of maintaining the speed of travel of a stepped carriage substantially linear during each print cycle, by allowing sufficient time to dissipate any kinetic energy-imparted carriage bounce forces due to built-in backlash that have not been completely absorbed or otherwise damped by the drive nut-carriage coupling assembly.

In accordance with the principles of the present invention, the above and other objects are realized in one preferred illustrative method applicable for use with a lead screw driven dot matrix printer, for example, by delaying each successive print cycle associated with a stepped advancement of the carriage by a predetermined time interval relative to the start of rotation of the stepping motor. More specifically, the print head is only actuated after the built-in axial backlash or clearance between the carriage drive nut and lead screw threads is taken up, and any kinetic energy imparted carriage transient bounce forces have been allowed sufficient time in which to become sufficiently damped.

At that time, the lead screw threads will be smoothly biased against the mating threads of the drive nut, with both thereafter moving in a direct, linear relationship. This may typically require a print cycle delay in the range of 4 to 18 milliseconds, based on a total operating printer cycle time of about 25 milliseconds per character, for example, and require within the delay period an initial lateral displacement of the carriage in the range of 1.2 to 1.6 times the backlash clearance.

After the described delay, the print head is actuated to start a given print cycle, with printing effected at the first dot position in the first (or any other desired) print column. Printing then continues, of course, at equally timed intervals and, hence, with equal spacings between all possible dot positions within that print column, as the carriage is then being driven at a constant speed.

Just before printing takes place in the last dot position for the last character of each stepped advancement of the carriage, the stepping motor is stopped. At that point in time, the lead screw and carriage inertia, and the backlash therebetween are all relied upon to advance the print head at a constant speed past the last dot position in question. In other words, backlash and inertia are relied upon to provide an overshoot of the carriage after the stepping motor and lead screw are no longer providing driving torque.

The described delay before printing commences in each print column and the utilization of carriage and lead screw overshoot has been found to produce very precisely spaced dots forming each matrix character along each print line, even when printing takes place at very high rates, such as of the order of 40 characters per second. This results, of course, because printing is only allowed to occur along a linear portion of the carriage displacement versus time curve associated with a given printer.

It has also been found that the most effective utilization of the linear portion of such a curve with a dot matrix printer may often be realized when each character is formed with a width that encompasses five out of seven timed intervals, rather than the more common 5 out of 6 timed intervals, with the total time and displacement of each character remaining the same in both cases.

Notwithstanding the many advantages realized with drive nut-carriage assemblies of the above type, it has been found in certain high speed printers incorporating carriage-print head assemblies having appreciable mass, that a energy absorbing O-ring coupling member of the type in question cannot always completely damp the initial kinetic energy imparted carriage impact bounce force and, thereby, eliminate the possibility of any related transient bounce forces.

As previously mentioned, the presence of even minor transient bounce forces, resulting from deliberately built-in backlash or clearance between the drive nut and lead screws threads, can have serious consequences with respect to the precise horizontal spacing of successive dots in each matrix character along each print line. The problem of uniform dot spacing, of course, increases in direct relationship with such factors as the mass of the carriage (and print head), the speed of travel thereof, and the degree of backlash employed. Thus, in addition to a resilient energy absorbing type of drive nut coupler, there has been a need for a method of completely and reliably eliminating any transient bounce forces which cause non-linear motion before printing commences.

Figure 2:
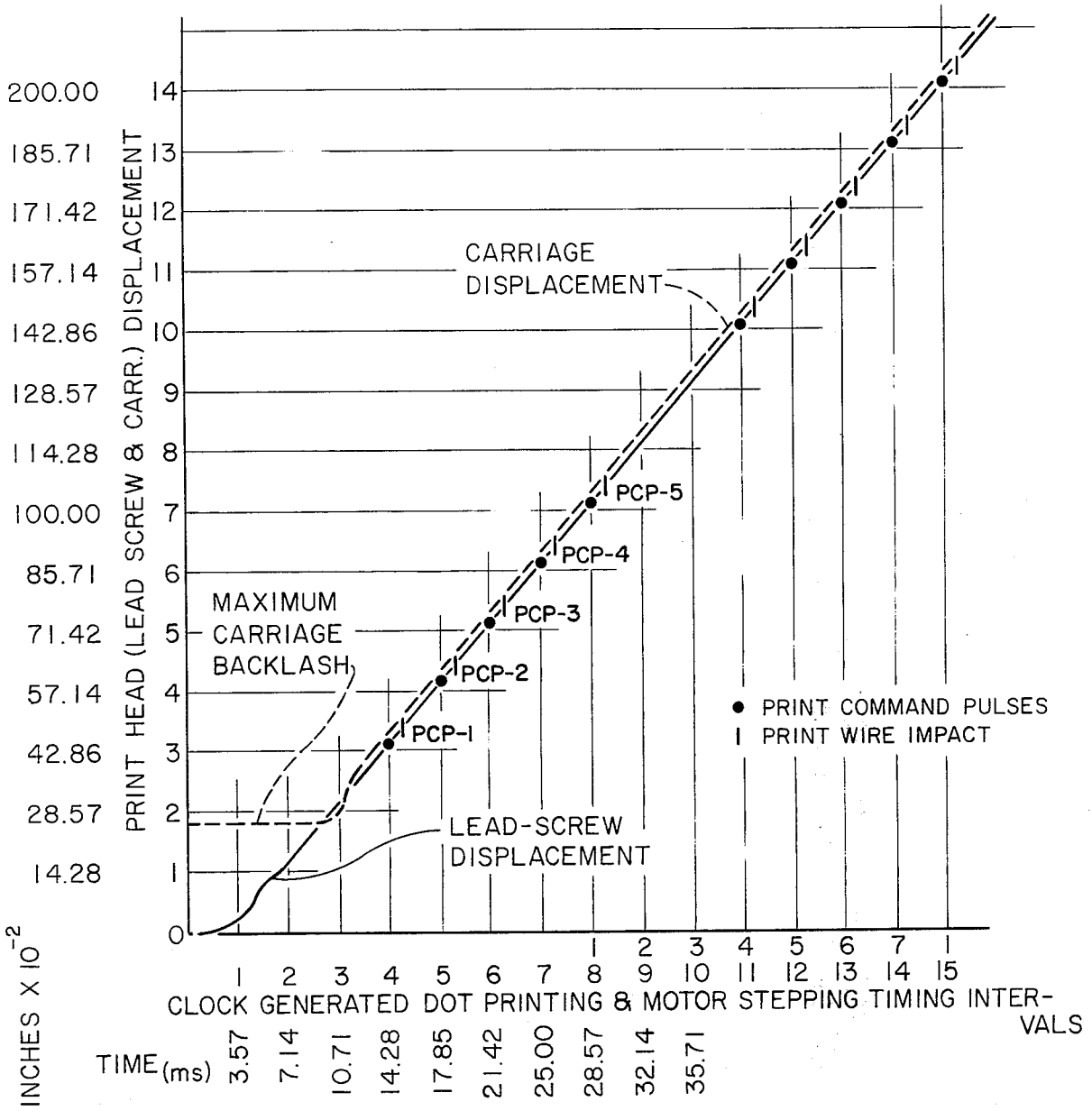
FIGS. 2 and 3 are lead screw and carriage displacement versus time graphs illustrating the predetermined initial print cycle delay period employed in single and multiple character stepped advancements of the carriage respectively, and with both graphs showing typical print head operating points along the linear portion of each graph for effecting dot character printing, and resiliently mounted to the carriage in a cantilevered manner, such as through the use of an O-ring coupling member, as disclosed in the aforementioned Lindberg application, can also readily compensate for any bow in the lead screw, or misalignment thereof relative to the carriage guide rods 18 and, thereby, further contribute to the minimizing of wear.

Accordingly, in accordance with an aspect of the present invention, the actual print cycle time associated with each stepped advancement of the carriage and print head is delayed until the threads of the lead screw 19 have actually been brought into continuous-driving engagement with the threads of the drive nut 20. This is best illustrated in FIG. 2 which depicts not only the delay period before printing takes place, but the subsequent, uniformly spaced points in time when the print command pulses (PCP1-5) are applied to the print head for two successive characters to be printed. The solid line represents the translational lateral displacement effected by the lead screw, and the dashed line represents the actual lateral displacement of the carriage and print head as driven by the lead screw.

Figure 1:
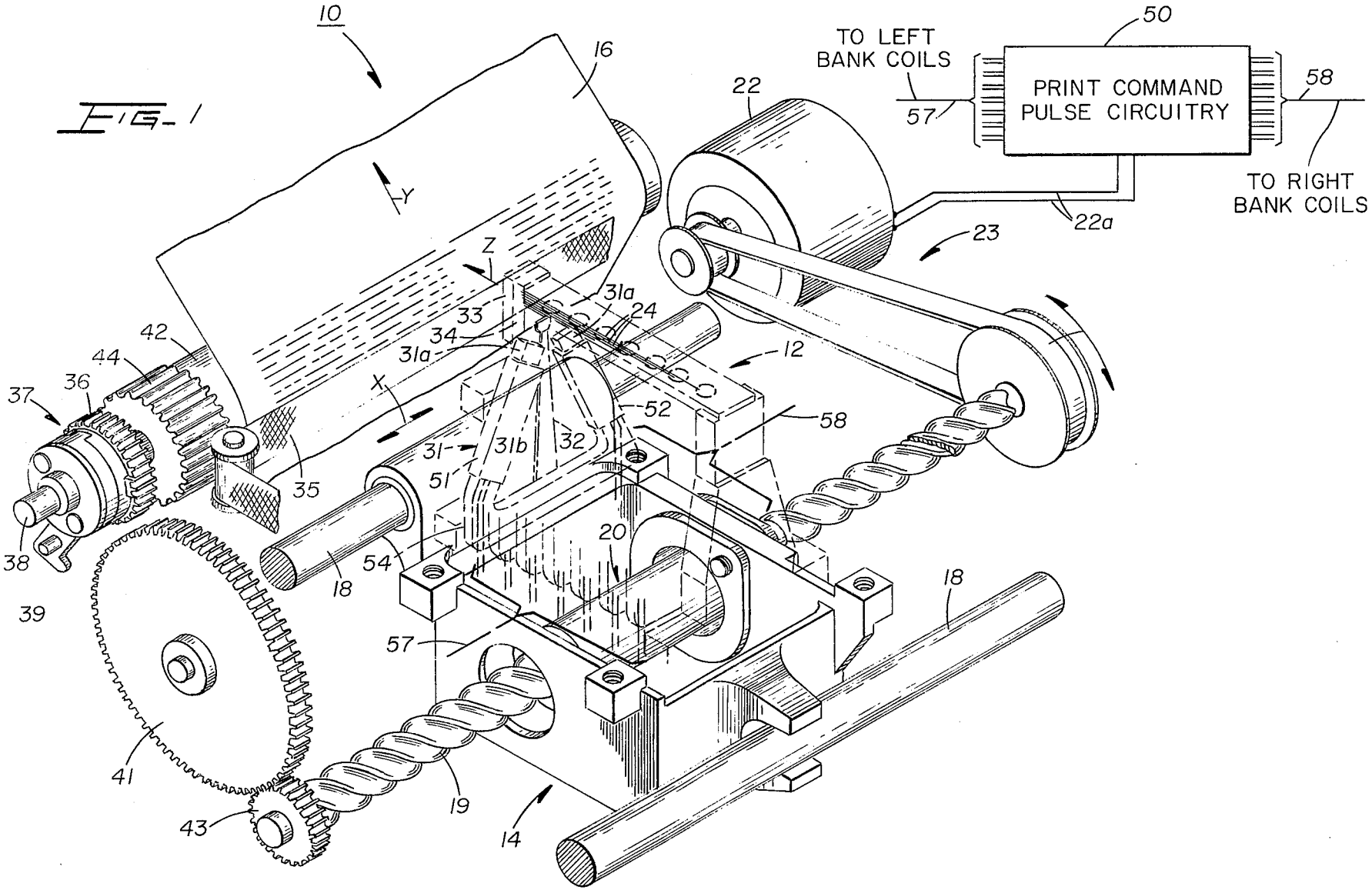
FIG. 1 is a partially broken away perspective view of an illustrative high speed dot matrix printer, with some parts being omitted in the interest of clarity, and which printer is capable, with stepping motor logic circuitry associated therewith, of driving the carriage mounted print head in a time-linear manner during a major portion of each stepped advancement thereof in accordance with the principles of the present invention.

With the illustrative printer of FIG. 1 operating at a printing speed of 40 characters/second, and utilizing a resilient coupling assembly of the type disclosed in the aforementioned Lindberg application, it is seen in FIG. 2, that it takes approximately 14 milliseconds for the carriage 14 to commence advancing at the same translational rate of speed as the lead screw 19. It should be understood, however, that the method of delayed printing disclosed herein may also be utilized without a energy-absorbing type of drive nut coupling member, if the inherent frictional forces produced by the lead screw-drive nut-carriage assembly generates friction in the range of 1.5 to 2 inch-ounces in magnitude. It has been found that if such friction is less than 1.5 inch-ounces, the transient bounce forces require too long a period to settle out, whereas a degree of friction somewhat larger than 2 inch-ounces can lead to excessive wear of the mating parts establishing such forces.

Out of the aforementioned total print cycle delay of about 14 milliseconds, and with reference again to FIG. 2, it is seen that it takes approximately 3.5 milliseconds for the stepping motor to accelerate the lead screw 19 up to a linear rate of speed. With respect to one particular type of stepping motor, this initial motor-dependent delay (while the motor is under partial load) typically requires approximately 15° of angular rotation of the motor shaft, starting from a so-called "IDLE POWER MODE" (i.e., an operating period when a reduced current is applied to the electromagnetic coils of the motor to maintain the rotor accurately positioned and essentially stationary, or detented).

In addition to the stepping motor portion of the total print cycle delay (3.5 milliseconds), it is also seen in FIG. 2 that it takes approximately an additional 10.5 milliseconds to completely take up the backlash between the lead screw 19 and the drive nut 20, when such backlash is of the order of 0.025 inch, for example, and to completely damp any kinetic energy imparted transient bounce forces resulting from such backlash. Out of this additional delay period of 10.5 milliseconds, approximately the first 6.3 milliseconds is allowed for taking up the backlash, with the remaining 4.2 milliseconds allowed to dissipate any impact bounce forces produced by the then driven carriage. The total print cycle delay results in an initial translational displacement of the lead screw of approximately 0.040 inch. This includes an initial maximum translational lateral displacement of 0.025 inch by the lead screw alone, followed by a minimum lateral displacement of 0.015 inch by the lead screw and carriage together.

From approximately 14 milliseconds or until the carriage is deliberately decelerated, it is seen in FIG. 2, for multiple character printing, that the lead screw 19 smoothly drives the drive nut-carriage assembly in a linear displacement versus time relationship both during and between successive print cycle periods. As such, the logic circuitry need only delay the start of printing with respect to the first character (or other indicium) associated with each multiple character advancement of the carriage in accordance with the principles of the present invention. Thereafter, all succeeding characters will be printed with no backlash compensation being required, as long as the speed of carriage travel is not interrupted.

The actual timing of the firing of the print wires 24 may be readily correlated with carriage displacement utilizing conventional pulse timing circuitry for both the print head 12 and the stepping motor 22. Such circuitry may be of the type employed and generally described in the aforementioned DeBoo et al. application. The ability of such conventional logic circuitry to also be readily adjusted to effect the necessary print cycle time delay embodied in the method of the present invention, is fully appreciated by reason of the short operating delay incorporated by necessity in such circuitry heretofore. More specifically, in all lead screw (as well as in chain and belt) driven printers employing a stepped carriage mounted print head, there must always be a short built-in time delay to allow the (stepping) motor to bring the coupled lead screw (or other apparatus) up to the desired speed. As previously mentioned, in the illustrative printer this requires approximately 3.5 milliseconds.

In view of the fact that it only requires a modified time delay adjustment of conventional logic control circuitry to carry out the principles of the present invention, such circuitry is only generally disclosed in block diagram form in FIG. 1, and identified by the reference numeral 50. It is believed sufficient to simply FIG. 4 is a symbolic representation of the horizontal dot spacings for two adjacent characters, with various approximate dimensions given so as to better understand the print wire firing and impact times and spacings in FIGS. 2 and 3.

DETAILED DESCRIPTION OF THE INVENTION

The present invention has universal application in lead screw driven printers, but for purposes of illustration, is being disclosed herein in connection with a high speed dot matrix printer 10 of the type depicted generally in FIG. 1.

Such a printer is of the class wherein a print head 12, shown only in phantom outline form, is mounted on a carriage 14 for lateral reciprocal movement in a horizontal direction (X) in front of and across the width dimension of a web 16, such as paper in roll stock form, or any other suitable record medium on which printing is to take place. It should be appreciated that the carriage 14 and the print head 12 mounted thereon may be either stepped to each successive character print column position during the printing of a given line, or be driven at a constant speed therealong, with the return of the carriage and print head to the "home" position being accomplished at a preferably faster constant or continuous accelerating rate of speed. In most printing applications, the carriage mounted print head 12 is stepped in various multiples of character increments across each print line, as the incoming data is normally not received at a continuous rate.

The carriage 14 is driven along a pair of guide rods 18—18 by means of a rotatably driven lead screw 19, which is coupled to the carriage 14 by means of a specially constructed and mounted drive nut 20, which will be described in further detail hereinafter. The lead screw 19 is suitably journalled at opposite ends in frame structure (not shown) for rotation, and is reversibly driven by a power source 22, such as a stepping motor, through a suitable drive train which, as depicted, comprises a belt pulley assembly 23.

In the present illustrative printer embodiment, the print head 12 includes a vertical column of seven selectively actuable print wires 24, shown only in fragmentary form, for use in printing 5 × 7 dot matrix characters (or nine similarly oriented wires for 5 × 9 dot matrix characters). The print wires 24 may be selectively actuated by respectively associated electromagnetic actuator assemblies, for example, with only the first of seven being shown in phantom outline form and identified by the numeral 31 of FIG. 1. These assemblies are arranged in a compact, horizontally spaced, and vertically stepped array so as to correspondingly position the horizontally disposed print wires 24 in a stepped and vertically stacked array as shown in FIG. 1.

Each actuator assembly 31 includes an associated one of a corresponding number of vertically extending and pivotally mounted flat spring armatures 32, only the first one nearest the paper 16 being shown in phantom in FIG. 1. Each of the print wires 24 is connected to the upper end of a different one of the armatures 32 in such a manner that each armature, when magnetically drawn backward against a pair of pole faces 31*a* of an essentially triangularly shaped core 31*b* of the associated actuator assembly, retracts the print end of the attached wire within a multibored guide block 33, supported on a face plate 34. Thereafter, upon the selectively and logically controlled release of each magnetically held armature 32, the spring-biased force thereof will release the print wire connected to the upper end thereof in the designated Z direction.

As a result, each "fired" or abruptly released wire is propelled against a discrete area of an inked ribbon 35, with the latter then being driven against the paper 16 so as to effect the printing of a particular dot of a given dot matrix character on the paper. To effect such dot matrix character printing, it is obvious that the print wires must be fired in a specific sequence for each character to be printed. For a more detailed description of one preferred embodiment of the dot matrix print head 12 which has been only generally described hereinabove, as well as of suitable operating control circuitry for actuating the print wires, none of which is critical or important with respect to an understanding of the present method for effecting delayed, linear print cycle advancement of a lead screw driven print head, reference is again made to the aforementioned copending application of J. L. DeBoo et al.

Before considering the present invention in detail, it may also be beneficial to first briefly describe a typical mode of operation of the printer 10. It is readily apparent that after the carriage mounted print head 12 has been either stepped or continuously driven to the right in the (X) direction, as viewed in FIG. 1, so as to effect the printing of a desired number of dot matrix characters along a given print line, the carriage 14 is rapidly returned to the home position. At that time a line feed takes place, i.e., the paper 16 is stepped or advanced one or more line printing spaces in the vertical (Y) direction in preparation for printing a new line of character information.

To effect such line feeding, a rotatable platen gear 36, comprising part of a line feeding mechanism 37 (shown only generally in FIG. 1), is eccentrically displaced relative to the platen support shaft 38, by a pivotally actuated lever 39, so as to engage an intermediate gear 41 and, thereby, effect the coupling of a platen 42 to a lead screw driven gear 43. In this manner, the platen 42 can be rotated to effect line feeding whenever the lead screw 19 is rotated. For a more detailed description of one preferred line feed mechanism of the type generally shown herein for effecting both single and multiple line feeding independently of carriage position, and with automated detent lever release of a platen-associated ratchet wheel 44, so as to effect very quiet multiple line feeding, reference is made to another commonly assigned copending application of I. B. Hodne, Ser. No. 468,048, filed May 8, 1974, also herein incorporated by reference.

BACKLASH COMPENSATED LINEAR DRIVE FOR STEPPED PRINTER CARRIAGE

With the foregoing general description of one dot matrix printer as background, attention will now be directed to a new and improved method of compensating for lead screw-drive nut backlash so as to maintain the speed of travel of the carriage mounted print head linear with time during each print cycle.

In accordance with the principles of the present invention, the dimensions of the internally threaded axial bore in the drive nut 20, relative to the threads of the lead screw 19, are purposely formed so as to provide a backlash or clearance generally in the range of 0.010 to 0.050 inches. Such a clearance, of course, advantageously allows the drive nut 20 to compensate for any tolerance variations in the threads of the lead screw 19. Moreover, such a nut, when specially constructed and state at this point that each electromagnetic actuator assembly 31 includes a preferably serially connected pair of coils 51,52, each mounted on a different leg portion of the triangularly shaped magnetic core 31*b*, only the first of seven being shown in FIG. 1. With the seven electromagnetic actuator assemblies 31 constructed and arranged as described hereinabove, it is seen that the respective armatures 32 thereof are free to pivot or flex in an arcuate path toward or away from their respectively associated core pole faces, which direction depending on the presence or absence of a magnetizing force.

Sequential energization of the coils 51 and 52 of each actuator assembly 31 is accomplished by the conventional logic control circuitry 50 supplying print command pulses (PCP) of a predetermined polarity and magnitude at the proper times to the coils of each assembly 31. Such pulses are shown applied to the left and right banks of coils 51 and 52 over the detached leads 57 and 58, respectively.

Figure 3:
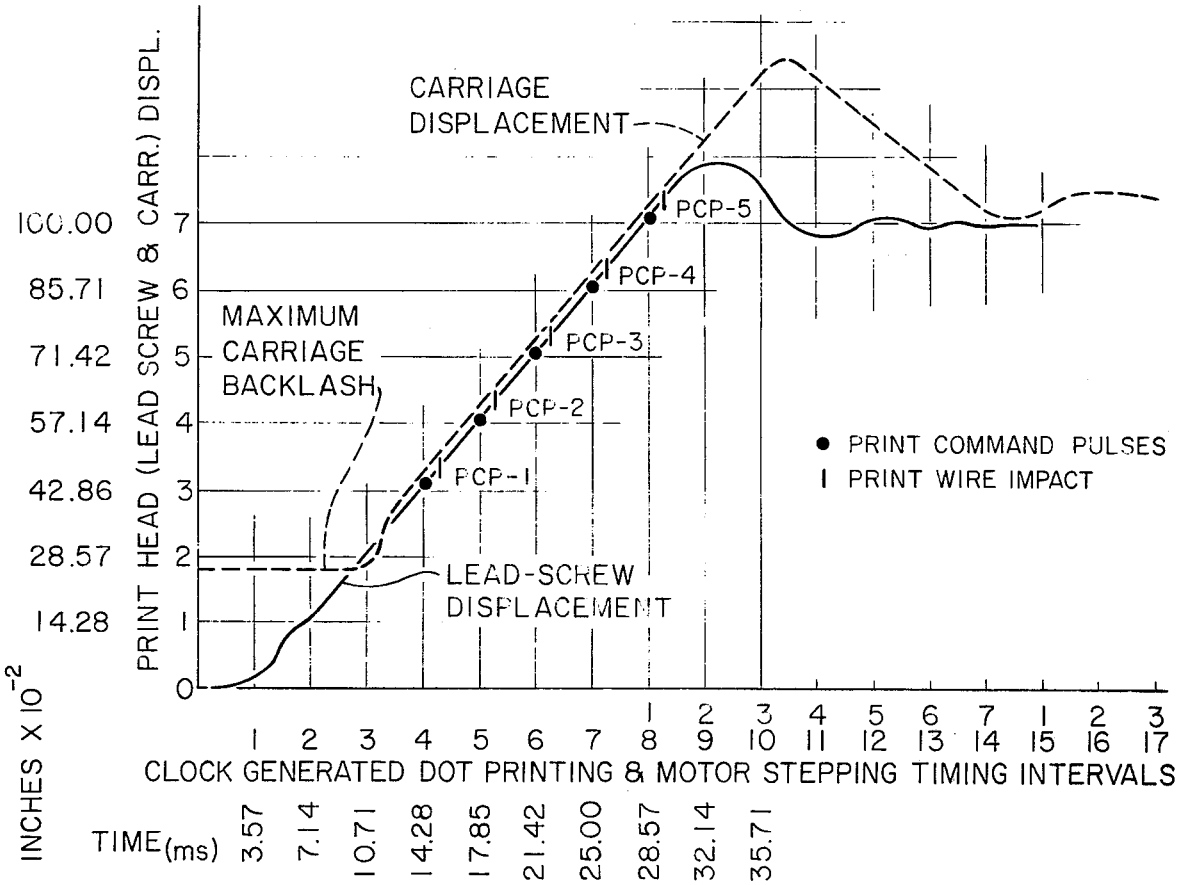
Figure 4:
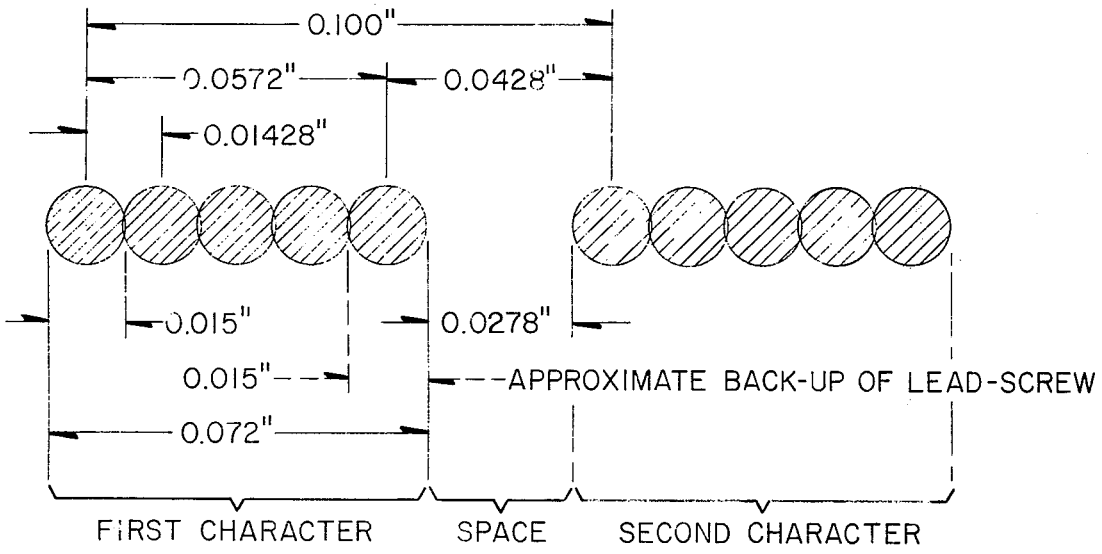

The PCP pulses are normally, but not necessarily, synchronized with timing pulses, represented by the numbered dot position timing intervals depicted along the abcissa in FIG. 2 (as well as in FIG. 3). Such timing pulses are conventionally generated by a clock source, for example, in the logic circuitry 50. These clock pulses thus enable the stepping motor and print command pulses (PCP1-5) to be synchronized for each printer operating cycle. In the illustrative printer, for example, each non-stepped character column advancement of the carriage (i.e., without interruption between the first dot position of one character and the first dot position of the next succeeding character, as depicted in FIG. 2) encompasses a total of 25 milliseconds (7 clock pulse timing intervals). The actual print cycle (for printing dots in the five horizontal dot positions associated with each matrix character) requires only 4 × 3.57 or 14.28 milliseconds. As depicted in FIG. 4, during each defined print cycle (of 14.28 milliseconds), and character column advancement (of 25 milliseconds), the carriage is laterally advanced 0.0572 inch and 0.100 inch, respectively, with the latter actually being defined between the fourth and eleventh timing clock pulses, as numbered in FIG. 2, because of the initial delay in the start of printing in accordance with the principles of the invention.

In connection with printing, it is also seen in FIG. 2 that the actual impact of selective print wires 24 at each of the five equally spaced dot positions (noted by vertical bars) for each character along the linear portion of the operating curve follows the respectively associated print command pulses (PCP1-5, denoted by dots) by approximately 1.25 milliseconds. This results from both the inherent delay in the electromagnetic actuator assemblies, and the transit time involved in the print wires being driven against the print medium.

Attention is now directed to FIG. 3, which depicts a typical stepped carriage mode of printer operation and, in particular, illustrates how the combination of backlash and lead screw-carriage-print head inertia are relied upon, rather than the stepping motor, to carry the print head at a constant speed past the last (fifth) dot position of a given character being printed, before the carriage uses up its kinetic energy and starts to decelerate. More specifically, power to the stepping motor 22, supplied from the logic control circuitry over leads 22*a*, is switched to a so-called "SETTLING MODE" before printing in the fifth dot position (PCP-5) for a given character actually takes place. Thus, from about 28 to 35 milliseconds, as seen in FIG. 3, the overshoot of the carriage is relied upon to carry the print head 12 at a linear rate of speed, even though the lead screw is decelerating at that time. Rapid deceleration of the carriage takes place only after the threads of the drive nut 20 impact the backside of the mating threads of the then rapidly decelerating lead screw.

With particular reference to the timing intervals of FIG. 3, it is seen that when the carriage-mounted print head 12 in the illustrative printer reaches the area defined between the second and third timing clock pulses associated with the second (or succeeding) character, as represented along the abcissa of the graph, the backlash and carriage inertia result in a progressively increasing overshoot of the drive nut-carriage assembly relative to the lead screw until the maximum backlash is reached. This typically occurs between the third and fourth timing clock pulses associated with the second (or next succeeding character) to be printed.

It should be noted that with the carriage and print head both moving at a substantially linear rate of speed between approximately 14 and 36 milliseconds, as depicted in FIG. 3, the start of printing for each stepped advancement of the carriage may actually be delayed until near or on the occurrence of the sixth timing clock pulse associated with each character to be printed, if desired. In that event, any printing in the fifth horizontal dot position of a given character would occur just before the stepped carriage (and print head) starts to decelerate.

Whenever the stepping motor 22 is stopped after each stepped advancement, a conventional built-in timing period of approximately 25 milliseconds is allowed for the rotor to not only stop rotating, but to substantially stop oscillating in preparation for the next stepped advancement of the carriage 14. During such quiescent periods, the stepping motor is preferably operated in the aforementioned "SETTLING MODE", wherein a reduced current is applied to the coils of the motor so as to force the rotor to seek a predetermined angular position relative to a given pair of magnetic poles on the stator.

During such deceleration to a complete stop of the motor, the rotor actually reverses direction of rotation by a limited number of degrees in seeking alignment with a given pair of magnetic poles. As a result, when the printing of a new character is to commence, it is necessary that the associated stepped advancement of the carriage start from a position that not only allows the backlash to be taken up, but also allows any impact carriage bounce forces to settle out before the print head is brought into alignment with the first dot position of the character to be printed.

The new starting positions for the lead screw and carriage are most clearly seen by an examination of the solid and dashed line curves representing translational lateral displacement of the lead screw and actual displacement of the carriage, respectively, in FIG. 3. Specifically, it is seen that before reaching the 15th consecutively numbered timing clock pulse, both the lead screw and carriage have actually been reversed in direction to positions which place the carriage on the left side of the fifth dot position of the last printed character. As previously mentioned, this is possible because the stepping motor advantageously will consistently stop rotating only after reversing direction a limited number of degrees.

This slight degree of reversed carriage displacement that occurs after each stepped advancement thereof is further visualized by reference again to FIG. 4, which illustrates the position of a single dot at each of the five horizontal dot positions for two adjacent characters along a given print line. As depicted therein, there is a centerlineto centerline spacing of 0.01428 inch between adjacent dots forming a given dot matrix print character, and a triple spacing of 0.0428 inch between the centerline of the fifth dot of one character and the centerline of the first dot of the next succeeding character. Thus, if in a given printer it requires approximately 0.040 inch of initial displacement of the lead screw to take up approximately 0.025 inch of carriage backlash, and to damp any kinetic energy imparted bounce forces of the carriage, it is seen that it is necessary for the stepping motor to actually reverse the direction of the lead screw. The print head may not back up because of backlash to a position to the left of the fifth dot position of the last printed character, and preferably by approximately 0.015 inch. This reversed displacement, which may vary somewhat in actual operation, is identified by the dashed line and the legend "Approximate Back-up of Lead-Screw" in FIG. 4.

This new starting position of the stepping motor thus allows approximately 0.040 inch of initial translated lateral displacement of the lead screw, as required in the illustrative example, before the first dot position for the second (or next succeeding) character is reached. Considered another way, should the threads of the lead screw be firmly biased against the threads of the drive nut at the beginning of the second stepped advancement of the carriage, the carriage would simply be advanced the entire 0.040 inch prior to any printing taking place at the first dot position of the second character. Conversely, if the entire 0.025 inch of backlash, in the illustrative example, separated the normally mating threads of the lead screw and drive nut at the start of the second stepped advancement of the carriage, then the carriage and print head would actually advance together approximately only 0.015 inch before printing could commence along the linear portion of the displacement versus time curve.

It is thus seen that there is a definite correlation between the degree of backlash employed, the spacing between characters and the operating characteristics of the particular stepping motor employed. While there is considerable flexibility involved in interrelating these factors, the end result must, of course, produce a print cycle delay after each stepped advancement of the carriage, in accordance with the principles of the present invention, that is sufficient to allow printing to take place along the linear portion of the operating displacement versus time curve for the particular printer in question.

In view of the foregoing, it is obvious that various modifications may be made in the present illustrative method of the invention, and that a number of alternatives may be provided without departing from the spirit and scope of the invention. For example, it should be appreciated that during each successively delayed print cycle, the PCP pulses need not be synchronized with the timing pulses for the stepping motor, other than with respect to the first PCP pulse associated with the first dot position following a stepped advancement of the carriage. Rather, the number of PCP pulses that may be generated during a given print cycle need only be dependent on the spacing required between dots for visual clarity and dot resolution. In terms of logic circuit simplicity, however, it may be desirable whenever possible to synchronize the PCP firing pulses with the motor timing pulses.

It also becomes readily apparent from the description of the invention hereinabove that the degree of backlash employed between the lead screw and drive nut may vary over an appreciable range, such as on the order of 0.01 to 0.04 inch, and that the built-in delay before printing commences in accordance with the invention may also vary over an appreciable range. More specifically, the delay in question depends primarily upon such inter-related factors as the characteristics of the stepping motor, the mass of the carriage-print head assembly, the inherent friction of the carriage assembly, the degree of backlash employed, and the type of coupling between the drive nut and carriage. As such, the minimum delay required for the carriage to be accelerated up to a uniform speed preparatory to printing may typically vary from 6 to 18 milliseconds in practice.

What is claimed is:

1. A method of driving a carriage-mounted print head, coupled through a threaded member to a motor-driven helical lead screw, in a manner that produces time-linear carriage motion for printing uniformly spaced indicia in rapid succession during each print cycle along a given print line, including the steps of:

establishing a predetermined maximum possible clearance between the threads of the threaded member and the lead screw;

starting the motor preparatory to printing;

delaying the printing of the first indicum not only until the motor and lead screw have been accelerated up to the desired angular rate of speed, but until the threaded member-lead screw clearance has been taken up, and any kinetic energy imparted carriage impact bounce forces resulting therefrom have been damped, at which time the carriage is then smoothly driven and at a substantially constant rate of speed by the lead screw;

printing said indicia associated with each print cycle at uniformly timed intervals and with uniform spacings along each print line as a result of said carriage being driven at a constant speed during each print cycle;

decelerating and stopping the motor prior to the printing of at least the last indicium associated with each print cycle preceding the stopping of the carriage; and relying on the inertial movement of the carriage and utilizing the clearance between the threaded member and the lead screw to propel the carriage and print head mounted thereon at said substantially constant speed during the printing of at least said last indicium.

2. A method in accordance with claim 1 wherein the carriage and print head mounted thereon are rapidly decelerated to a stop by the previously decelerated and stopped motor after said clearance between said threaded member and said lead screw has been taken up.

3. A method in accordance with claim 2 wherein said clearance between said threaded member and said lead screw is in a range between 0.010 and 0.040 inch, and wherein the total delay between the motor is started and printing commences encompasses a period of time in a range of 6 to 18 milliseconds.

4. A method of driving a carriage-mounted print head, coupled through a threaded member to a stepping motor-driven helical lead screw, in a manner that produces time-linear carriage motion for printing uniformly spaced indicia in rapid succession during each print cycle following each stepped advancement of the carriage, including the steps of:

establishing a predetermined maximum possible backlash between the threads of the threaded member and the lead screw so as to minimize friction and wear due to any lead screw-drive nut tolerance variations, bow in the lead screw, and misalignment thereof relative to the path of carriage travel;

starting the stepping motor preparatory to printing;

delaying the printing of the first indicium associated with each stepped advancement of the carriage until the motor and lead screw not only have been accelerated up to the desired angular velocity, but until the threaded member-lead screw backlash has been taken up, and any kinetic energy imparted carriage impact bounce forces resulting therefrom have been damped, at which time the carriage is then smoothly driven at a substantially constant rate of speed by the lead screw;

printing said indicia associated with each stepped advancement of the carriage at uniformly timed intervals and with uniform spacings along each print line as a result of said carriage being driven at a constant speed during each print cycle;

decelerating and stopping the stepping motor prior to the printing of at least the last indicium associated with each stepped advancement of the carriage, and relying on the inertial movement of the carriage and lead screw, and on the backlash between the threaded member and the lead screw to propel the carriage and print head mounted thereon at said substantially constant speed during the printing of at least said last indicium associated with each stepped advancement of the carriage.

5. A method in accordance with claim 4 wherein said carriage and print head mounted thereon are rapidly decelerated to a stop by the previously decelerated and stopped motor, but only after said backlash between said threaded member and said lead screw has been taken up.

6. A method in accordance with claim 5 wherein said backlash is in a range of 0.010 and 0.030 inch, and wherein said delay before printing commences after each stepped advancement of said carriage is chosen to fall within a range commensurate with the time required to advance said carriage initially by a distance in the range of 1.2 to 2.0 times the backlash.

7. A method in accordance with claim 6 wherein during the acceleration of said carriage, energy absorbing means, mounted between said carriage and threaded member, are utilized to facilitate the damping of said carriage impact bounce forces and, thereby, shorten the delay required between when the stepping motor is started and when printing commences.

8. A method in accordance with claim 6 wherein said total delay between when the stepping motor is started and printing commences encompasses a period of time in a range of 6 to 18 milliseconds.

9. A method in accordance with claim 5 wherein said backlash is in a range between 0.010 and 0.030 inches, and wherein said additional delay required to take up any backlash and allow any impact carriage bounce forces to be dissipated after the stepping motor has accelerated said lead screw up to the desired angular velocity, and before printing commences, is in a range of 3 to 15 milliseconds.

10. A method in accordance with claim 6 wherein said stepping motor, in stopping after each stepped advancement of said carriage, with the exception of the last stepped advancement along a given print line, first reverses said lead screw and subsequently decelerated carriage by fractional amounts relative to the respective and correlated displacements required thereof to move said print head between two adjacent indicia-defining print positions within a given print cycle, before the next stepped advancement of the carriage is initiated.

11. A method in accordance with claim 10 wherein said indicia printed during each print cycle comprise uniformly spaced dots forming alphanumeric dot matrix characters.

* * * * *